US005317767A

United States Patent [19]

Hargest et al.

[11] Patent Number: 5,317,767

[45] Date of Patent: Jun. 7, 1994

[54] SUDDEN INFANT DEATH SYNDROME PREVENTION APPARATUS AND METHOD

[76] Inventors: Thomas S. Hargest, 14 Lockwood Blvd., Apt. 10J., Charleston, S.C. 29401; William M. Hargest, 8470 Doar Rd., Awendaw, S.C. 29429

[21] Appl. No.: 899,462

[22] Filed: Jun. 16, 1992

[51] Int. Cl.[5] ..... A47C 21/04; A47D 7/00

[52] U.S. Cl. ..... 5/469; 5/423; 5/655; 5/461; 128/202.18

[58] Field of Search ..... 5/469, 468, 423, 284, 5/461, 636, 638, 655, 481; 297/180; 128/202.18, 205.26, 716, 848; 600/22

[56] References Cited

U.S. PATENT DOCUMENTS

| | | | |
|---|---|---|---|
| 2,025,659 | 12/1935 | Gilquin | 5/639 |
| 2,400,790 | 5/1946 | Tolen | 5/469 |
| 2,493,067 | 1/1950 | Goldsmith | 5/423 |
| 2,815,516 | 12/1957 | Holton | 5/461 |
| 3,135,974 | 6/1964 | Roman | 5/461 |
| 3,486,177 | 12/1969 | Marshack | 5/469 |
| 3,529,310 | 9/1970 | Olmo | 5/423 |
| 4,536,906 | 8/1985 | Varndell et al. | 5/468 |
| 4,620,337 | 11/1986 | Williams et al. | 5/481 |
| 4,686,724 | 8/1987 | Bedford | 5/481 |
| 4,768,251 | 9/1988 | Baskent | 5/481 |
| 4,898,164 | 2/1990 | Baumberg | 128/202.18 |

FOREIGN PATENT DOCUMENTS

| | | | |
|---|---|---|---|
| 1035073 | 7/1966 | United Kingdom | 5/468 |
| 1391506 | 4/1975 | United Kingdom | 5/468 |
| 2198940 | 6/1988 | United Kingdom | 5/468 |

OTHER PUBLICATIONS

Raloff, J., "Do Some SIDS Victims Actually Suffocate?" pp. 403, 405, Jun. 29, 1991, Science News-The Weekly Newsmagazine of Science.

Gilbert-Barness et al., "Hazards of Mattresses, Beds and Bedding in Deaths of Infants," pp. 27-32, 1991, The American Journal of Forensic Medicine and Pathology, vol. 12, #1, 1991.

Dwyer et al., "Prospective Cohort Study of Prone Sleeping Position and Sudden Infant Death Syndrome," pp. 1244-1247, May 25, 1991, "The Lancet," vol. 337.

Christine Gorman, "Beware of the Pillow," p. 48, Jul. 8, 1991, Time Magazine .

Kemp et al., "Sudden Death in Infants Sleeping on Polystyrene-Filled Cushions," pp. 1858-1864, Jun. 27, 1991, The New England Journal of Medicine.

*Primary Examiner*—Alexander Grosz

*Attorney, Agent, or Firm*—Dority & Manning

[57] ABSTRACT

A safety pad or mattress such as for use in a crib prevents sudden infant death syndrome by ensuring an oxygenated breathing space beneath the infant. Reticulated foam or other air permeable material is made into the shape of a pad or even a mattress and covered with a fitted open weave fabric covering. An air tube is embedded in the pad or mattress and interconnected with an air pump which circulates fresh, i.e., oxygenated, air in a breathing space formed beneath an infant by the air permeable mattress. The forced air circulation flushes any exhaled carbon dioxide from the breathing space, even when the infant is face down or otherwise in a prone position on the mattress, to prevent carbon dioxide poisoning. The materials of the fabric covering and air permeable mattress permit any fluids regurgitated from the infant to drain away from the infant's face. A relatively tight fit for the fitted covering obviates loose fitting sheets to further prevent potential entanglement and suffocation of a recumbent infant.

27 Claims, 5 Drawing Sheets

SUDDEN INFANT DEATH SYNDROME PREVENTION APPARATUS AND METHOD

BACKGROUND OF THE INVENTION

The present invention relates in general to apparatus and method for the prevention of sudden infant death syndrome and in particular to an infant safety pad or mattress and corresponding method for the prevention of infant asphyxiation from carbon dioxide poisoning.

Several thousand apparently healthy infants (children under the age of 1 year) die each year in the United States from Sudden Infant Death Syndrome (SIDS). Deaths from SIDS have been estimated at 7,000 to 10,000 per year. See for example *Womens Day,* volume 55, issue 3, Jan. 7, 1992, pages 38 through 43; and *USA Today,* volume 117, issue 2626, February 1989, page 11. The occurrence of SIDS in a given family can be particularly devastating emotionally because, in general, there is no warning that the infant is at risk and the parent or care giver has no knowledge of any problem until he or she discovers an unconscious or deceased infant thought to be safely sleeping in its crib.

The specific cause of SIDS is generally unknown, which unfortunately leads to the result that heretofore there has generally been no known treatment and generally no means of prevention.

While no specific cause or causes of the medical disaster are known, the medical community has produced several different theories. One such theory is that the victim infant suffers from some form of neurological disorder (cause unknown and existence undetected). The disorder operates to interrupt the infant's breathing (sometimes referred to as the infant simply "forgetting" to breathe) and death results due to suffocation.

Another theory also suspects infant suffocation, but not due to any neurological disorder interrupting breathing. Instead, it is believed that the infant becomes fatally poisoned by exhaled carbon dioxide which has become trapped or accumulated and then rebreathed by the infant. The theoretical possibility of SIDS death caused by the rebreathing of expired gases, oxygen deficient air, and/or by blocked air passages in bedding has been discussed in the medical and other literature. See for example *The Lancet,* volume 337, issue 7852, May 25, 1991, pages 1244 through 1257; *The Journal of the American Medical Association,* volume 263, issue 21, Jun. 6, 1990, pages 2865 through 2869; *The New England Journal of Medicine,* volume 324, issue 26, Jun. 27, 1991, pages 1858 through 1864; and *Time,* volume 138, issue 1, Jul. 8, 1991, page 48.

The reason that carbon dioxide poisoning from rebreathing of exhaled gases is suspected is because heretofore the conventional wisdom (i.e., the prevailing advice) has been for small infants to be placed on their stomachs (i.e., a prone position) for best rest and sleep. The reason for this is well known to any parent or care giver; a young infant will frequently regurgitate (i.e., spit up) previously ingested fluids and sometimes become choked by reswallowing the matter. This is a very natural and relatively frequent occurrence, and entirely different from vomiting due to any illness, because the digestive system of the infant at birth and for a time period thereafter is generally inadequately developed so as to consistently retain fluids. Such regurgitation often accompanies burping or hiccups.

If an infant were to be placed on its back (i.e., a supine position) so as to keep its face open and unblocked for safe breathing, there is a recognized and significant risk of aspiration from simple regurgitation of fluids. Aspiration (i.e., taking foreign matter into the lungs during breathing) can result in fatal choking. Matter regurgitated by an infant in a supine position would frequently be retained by gravity in the infant's mouth and potentially reswallowed (aspirated) during breathing. Therefore, to prevent this possibility, infants have been traditionally placed prone or face down for rest or sleep.

The size and weight of a newborn infant's head is relatively large in relation to the remaining body of the infant, and particularly in relation to the initial strength of the infant. Oftentimes a newborn infant is not even able to raise its head adequately so as to turn from one check to another, or to simply raise its face from against the bedding which it rests. Adequate strength for such movements develops relatively quickly, but still may take several weeks or more. Even so, an infant can tire quickly from simply trying to raise its head. At such resting times, and from other movements, an infant may place its own face straight down onto a crib mattress and into the bedding materials, despite any resulting blockage of air passages.

All of the foregoing leads to the situation that even newborn infants are typically placed (at least initially) in a relative prone position (with their head typically turned to one side) for rest or sleep.

A typical conventional crib mattress for supporting an infant takes the form of some resilient or softened pad either relatively impermeable to air, or more often covered with a solid vinyl or plastic permanent covering so as to give form and shape to the mattress and particularly so as to prevent the mattress inner portion from becoming wet from infant regurgitation or other discharges. In other words, a vinyl mattress cover is readily cleaned if there is any spit up or diaper leakage from the infant.

At the same time, due to its relatively uncomfortable vinyl cover, the conventional crib mattress is often further covered with a cloth pad, sheet, baby quilt, or the like, all of which may be relatively loose fitting. In addition, a light blanket or similar object may be used to cover a portion of the infant for warmth. Still further, an infant or young child may have a cloth diaper or similar small blanket which it clutches or grasps in its hands and draws close to it, sometimes close to its face as it snuggles against such blanket or even against the mattress on which it rests.

The foregoing arrangement can result in a combination of materials from which a fragile but not unhealthy baby may be unable to become untangled (if entanglement occurs). As the accident events progress and an infant begins to rebreath the carbon dioxide which it exhales, it becomes weaker to the point of collapsing face down into the bedding mattress. It then continues to rebreath the exhaled carbon dioxide to the point of becoming unconscious, and the infant medically deteriorates from that point to the point of death.

The likelihood of carbon dioxide poisoning as a cause or major factor in SIDS has been regarded as so great and the certain results therefrom are so catastrophic that some pediatricians have recently begun recommending for the first time that infants be placed on their backs for sleeping (i.e., in a supine position). In other words, the previously recognized risk of aspiration from regurgitation by an infant sleeping on its back is believed by some as outweighed by the risk of asphyxiation from carbon dioxide poisoning by an infant sleeping in a prone position.

In the medical care field, it has heretofore been practiced to provide known sick or at risk patients "oxygen therapy." Where a patient has a particular respiratory condition or other demanding condition, pure oxygen or air with an enriched percentage of oxygen may be given to patients such as through either a mask applied to the patient's face or through a tent enclosing the head or upper body portion of the patient. Neonatal anesthesia masks exist but have not generally been used for an infant or small child who was not undergoing some specific therapy or which was not under some specific medical care.

Air circulation in a specific sense has heretofore been practiced in conjunction with certain mattress technology for the intended purpose of preventing and/or treating decubitus ulcers. Ulcerated areas of the skin or bed sores can occur from prolonged or excessive pressure to a specific body point during bed rest, and/or from trapped heat and perspiration. These conditions can be treated and/or prevented by the circulation of air in the vicinity of affected areas. Potentially affected areas typically include bony prominences, for example, such as at the patient's hips, knees, and ankle joints.

Bedford (U.S. Pat. No. 4,686,724) discloses air channels 19 through an open cell foam pad for the intended purpose of preventing decubitus ulcers. Plugs 21 and 22 may be removed from channels 19 in certain areas of the pad body for the creation of air channels in the corresponding area. Williams et al. (U.S. Pat. No. 4,620,337) discloses (column 1, lines 40 through 51) the use of inflatable cells which are alternately inflated and deflated (called alternating pressure pads) for preventing the formation of decubitus ulcers. In column 5, lines 10 through 15, the patent also refers to the use of rib design in the mattress for promoting air circulation between the pad and the patient to disperse body heat and reduce moisture build-up, both related to the formation of decubitus ulcers, and for promoting increased air flow through open cells of the foam pad. Baskent (U.S. Pat. No. 4,768,251) discloses in column 3, lines 4 through 55, the idea of using alternating peaks and valleys to form convolutions which allow air to pass around the peaks thereof through such valleys, again for the purpose of preventing the formation of decubitus ulcers.

SUMMARY OF THE INVENTION

The present invention recognizes and addresses such problems and others arising from Sudden Infant Death Syndrome. Thus, broadly speaking, a principal object of this invention is the prevention of Sudden Infant Death Syndrome. More particularly, a main concern is improved apparatus and method for an infant safety pad or mattress for the prevention of infant asphyxiation, such as from carbon dioxide poisoning.

It is another particular object of the present invention to provide a new form of crib safety apparatus and method for the prevention of SIDS due to carbon dioxide poisoning. More specifically, it is a present object to provide a crib safety pad or mattress for infants which permits elimination of potential contributing factors to carbon dioxide poisoning such as loose bed sheets and impervious pads or mattresses beneath the sheets which preclude air flow therethrough.

It is another general object of the present invention to provide apparatus and method which establishes a safety breathing space beneath a support surface of a pad or mattress and circulates fresh (i.e., oxygenated) air in such space so as to flush and prevent potentially dangerous accumulations of carbon dioxide in such space.

Still another present object is to provide improved apparatus and method which eliminates the potential problem of infant rebreathing of exhaled gases, such as carbon dioxide, to reduce and hopefully eliminate the incidence of SIDS. It is a further object to permit resting or sleeping infants to once again be safely placed in a prone position, but without risk of carbon dioxide poisoning, so as to reduce the risk of aspiration from regurgitation of fluids.

Another present object is to provide method and apparatus for the prevention of SIDS so as to not only eliminate the accidental deaths of the victim infants, but so as to eliminate the traumatic and perhaps devastating effects on family members and other care givers of the accidental victims.

Additional objects and advantages of the invention are set forth in, or will be apparent to those of ordinary skill in the art from, the detailed description which follows. Also, it should be appreciated further that modifications and variations to the specifically illustrated and discussed features, materials, or steps hereof may be practiced in various embodiments and uses of this invention without departing from the spirit and scope thereof, by virtue of present reference thereto. Such variations may include, but are not limited substitution of equivalent means, features, materials, or steps for those shown or discussed, and the functional or positional reversal of various parts, features, steps, or the like.

Still further, it is to be understood that different embodiments, as well as different presently preferred embodiments, of this invention may include various combinations or configurations of presently disclosed features, elements, or steps, or their equivalents (including combinations of features or steps or configurations thereof not expressly shown in the figures or stated in the detailed description). One exemplary such embodiment of the present invention relates to an infant safety device for the prevention of infant asphyxiation. Such safety device comprises the combination of a particular support pad with forced air circulation means in accordance with the invention. The support pad preferably has an upper support surface and is comprised of air permeable material therebeneath so that a breathing space is created below an infant received on such upper support surface. The forced air circulation means are operative for circulating oxygenated air through the breathing space so that carbon dioxide exhaled by an infant received on the upper support surface is flushed from such breathing space so as to prevent asphyxiation of the infant due to carbon dioxide poisoning.

Another present exemplary embodiment concerns a crib safety apparatus for the prevention of SIDS due to carbon dioxide poisoning. Such apparatus preferably includes a generally rectangular mattress or pad formed of air permeable materials so as to be received in a crib, fabric cover means fitted thereto, and air pump means.

The above-referenced mattress preferably defines a generally flat upper support surface for receiving an infant thereon and further defines a breathing space of predetermined volume therebeneath. Embodiments thereof can include pads of about 0.5 to about 2 inches thick, or fuller mattresses such as about 2 to about 8 inches thick. The fabric cover means are fitted relatively tightly at least about the mattress upper support surface and are comprised of air permeable material. The air pump means is preferably operative for drawing fresh oxygenated air from around the crib surroundings and pumping the fresh oxygenated air into the breathing space so as to expel carbon dioxide from such breathing space. With such an arrangement, fresh oxygenated air is advantageously presented to an infant instead of accumulated exhaled carbon dioxide even whenever the infant is received face down onto the mattress upper support surface. Still further preferred, the air pump means should be selected so as to avoid contamination of the air.

Yet another construction comprising a present exemplary embodiment includes SIDS prevention apparatus having a generally rectangular crib mattress or pad comprised of air permeable reticulated foam, a fitted relatively open weave fabric covering received about such crib mattress and having at least one tube opening formed therein, an air tube of particular construction and location, and an air pump operatively interconnected with such air tube. The preferred air tube in such embodiment has opposing first and second ends, and resides at least partially in the crib mattress and passing through the fabric covering tube opening so that a first end of the air tube is received at a predetermined location inside of the crib mattress while a second end of the air tube is situated outside of the crib mattress. The air pump is operatively interconnected with such air tube second end and is operative for continuously pumping fresh oxygenated air into the air tube such that the fresh oxygenated air emerges from the air tube first end and is forced throughout the air permeable reticulated foam crib mattress. Such forced air flushes out and prevents any accumulation of exhaled carbon dioxide from an infant received in a prone position on the crib mattress. At the same time any regurgitated fluids from such infant are drained through the fabric covering.

In the foregoing embodiments, other optional features may be used. For example, the air to be circulated may be heated or cooled for having the same effect on the infant, or the oxygen content of such air can be enhanced (i.e., enriched).

It should be well understood by those of ordinary skill in the art that the present invention equally pertains to corresponding methods, a present exemplary embodiment of which relates to a method of preventing infant asphyxiation during periods of infant bed rest, such as in a crib. One exemplary such method comprises steps of providing a support pad having an upper support surface and comprised of air permeable material therebeneath so that a breathing space is created below an infant received on such upper support surface, and circulating oxygenated air through such breathing space so that carbon dioxide exhaled by an infant received on the upper support surface is flushed from the breathing space so as to prevent asphyxiation of the infant due to carbon dioxide poisoning.

Those of ordinary skill in the art will better appreciate the features and aspects of such embodiments, methods, and others, upon review of the remainder of the specification.

BRIEF DESCRIPTION OF THE DRAWINGS

A full and enabling disclosure of the present invention, including the best mode thereof, directed to one of ordinary skill in the art, is set forth in the remainder of the specification, which makes reference to the appended figures, in which.

Figure 1:
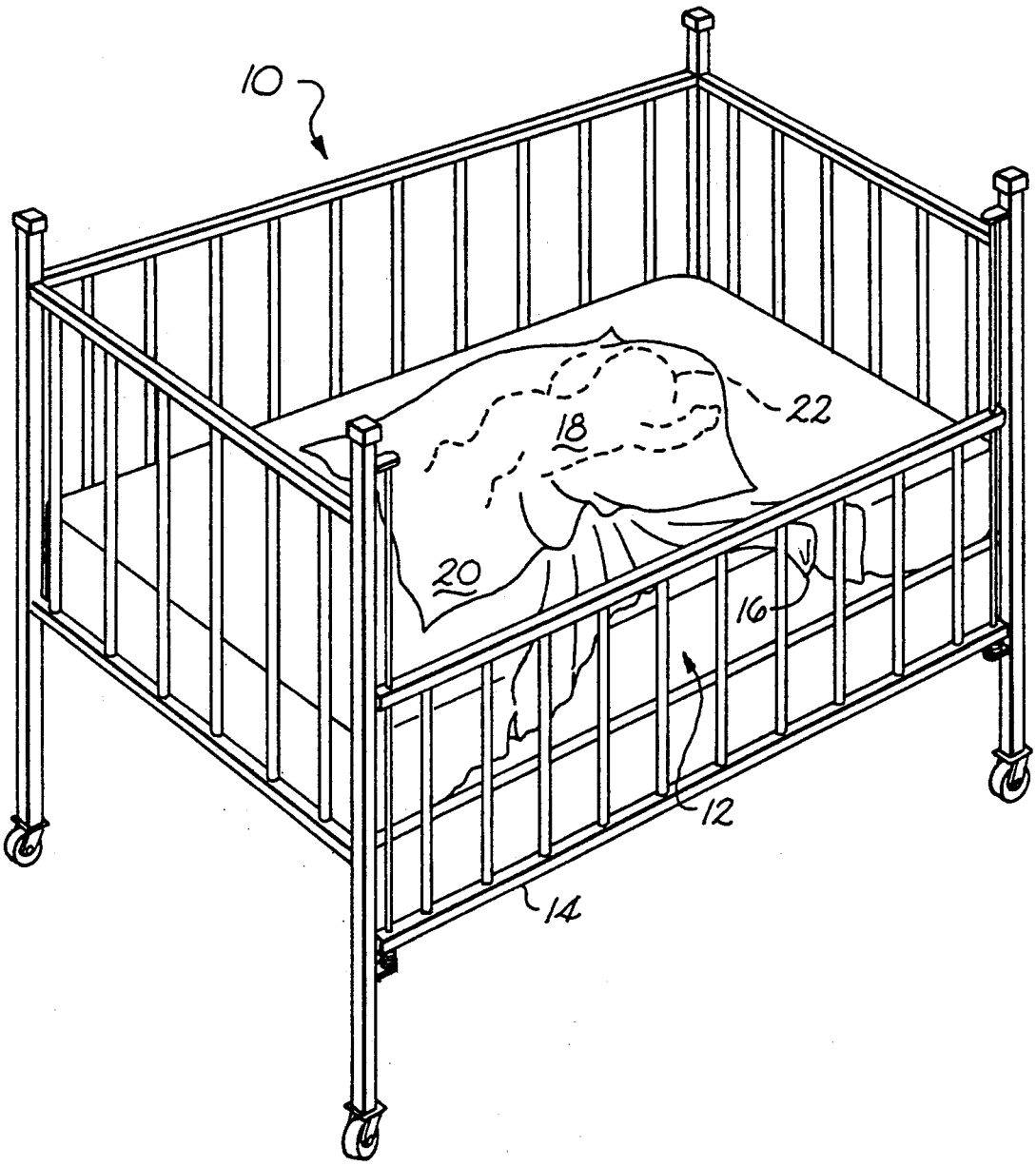
Fig. 1 PRIOR ART
FIG. 1 is a perspective view of a typical conventional or prior art crib with an infant received thereon in a prone position.

Repeat use of reference characters throughout the present specification and appended drawings is intended to represent same or analogous features, elements, or steps of the invention.

DETAILED DESCRIPTION OF THE PREFERRED EMBODIMENTS

FIG. 1 is a perspective view of a typical conventional crib generally 10 which may receive and support a conventional crib mattress 12 therein. The construction and support features of conventional crib 10 are generally well known to those of ordinary skill in the art and form no particular aspect of the subject invention, wherefore additional details of such crib 10 are not provided. One movable side 14 of crib 10 is lowered in the illustration of present FIG. 1 for greater clarity during the following discussion, though it will be understood that such side 14 is more typically in a raised position whenever the crib is occupied.

Oftentimes a relatively loose fitting sheet, mattress cover, or the like (generally 16) will be provided because mattress 12 has a vinyl or other plastic protective covering which would be relatively uncomfortable if received directly against an infant 18. When loose fitting, sheet 16 can become drawn up by movement of the infant, as represented in FIG. 1. On occasion, an additional blanket or covering 20 is applied for the warmth of the child 18. As represented in present FIG. 1, an infant may become accidentally entangled in the bedding mass or cloths comprising sheet/cover 16 and blanket 20, and other materials if present. On occasion, as represented, the head 22 of the prone positioned infant 18 is literally face down or otherwise turned so as to be blocked by mattress 12 and/or the bed clothing from a free flow of air, particularly fresh or oxygenated air. With such an arrangement, the potential for SIDS exists, as described above in detail.

Figure 2:
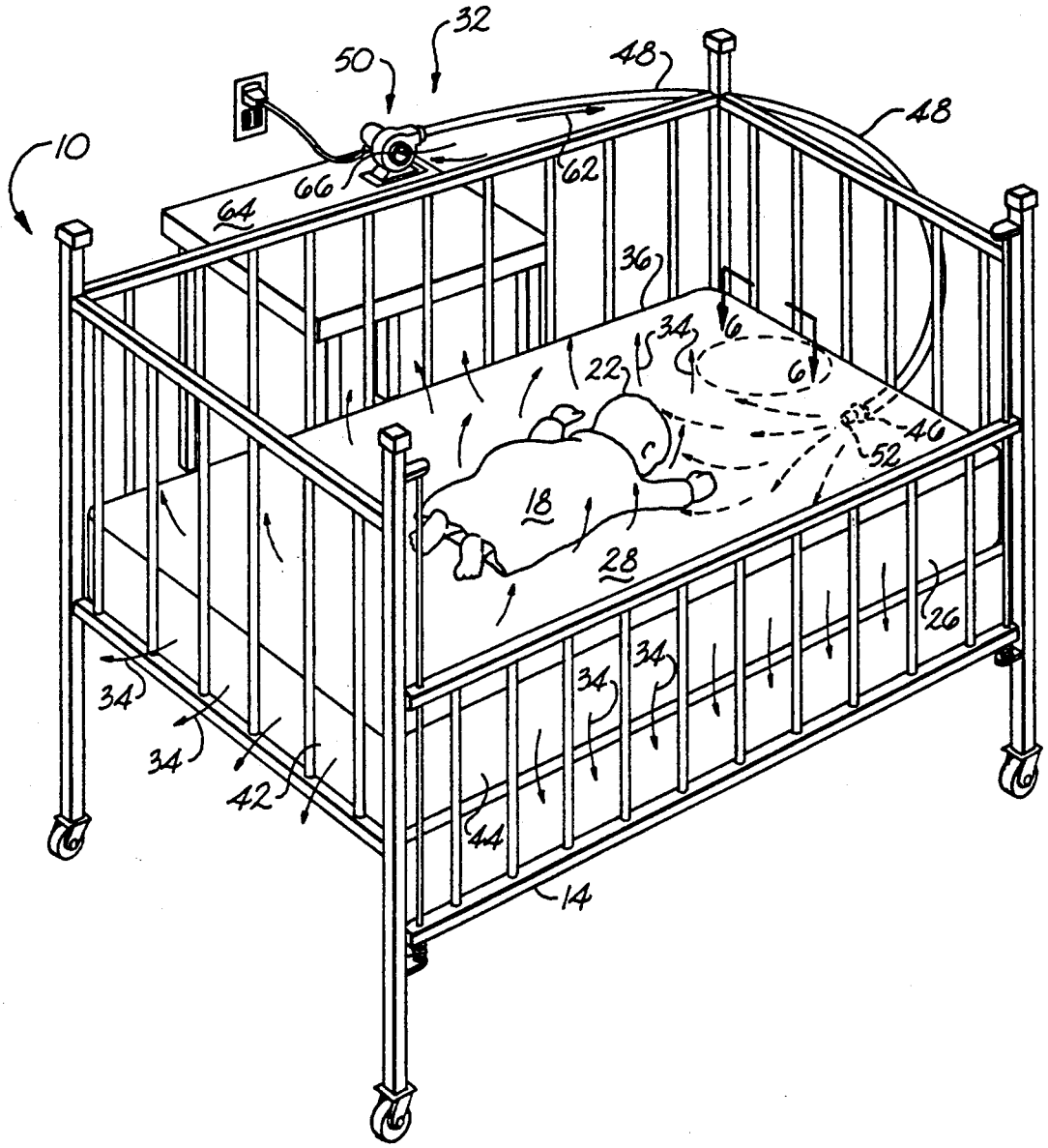
FIG. 2 is a view of a typical conventional crib such as shown in present FIG. 1, with an infant received thereon in a prone position, shown in combination with a first embodiment of an infant safety pad or mattress and corresponding methodology in accordance with the subject invention.

FIG. 2 illustrates another perspective view of typical or conventional crib 10 with an infant 18 received therein, but this time with other features in accordance with the subject invention combined therewith in place of conventional mattress 12, mattress cover 16, and the like. Again, crib side 14 is lowered for greater clarity in the illustration.

Figure 3:
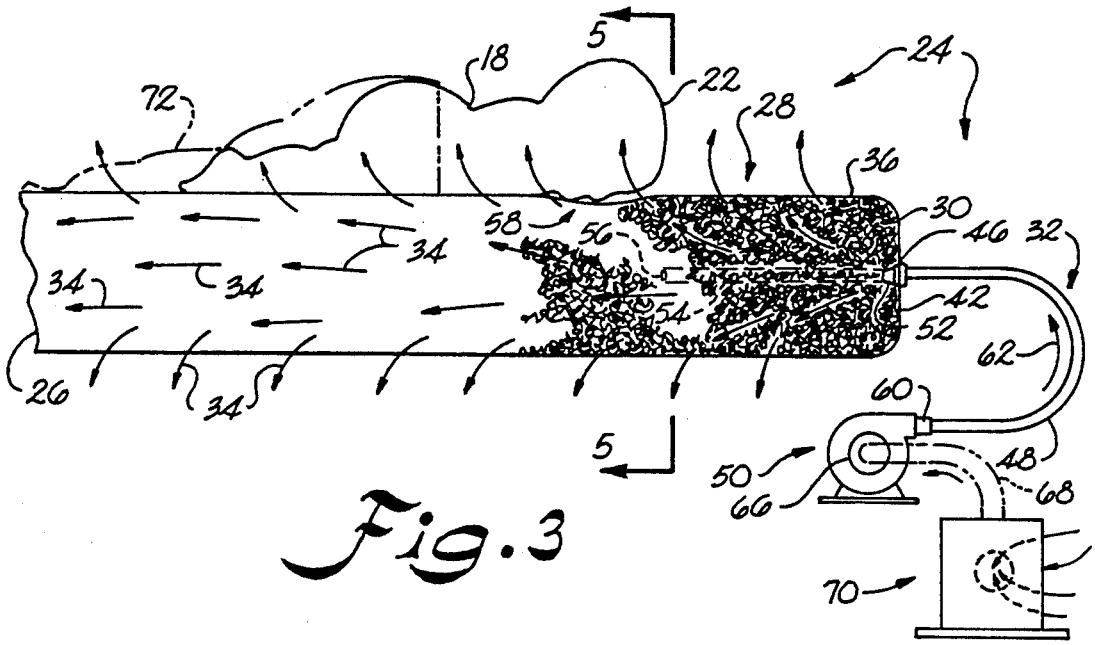
FIG. 3 is a generally side elevational view of a portion of the present apparatus and methodology represented in accordance with the exemplary embodiment of present FIG. 2.

FIG. 3 illustrates a side cross-sectional view (with some diagrammatical illustrations) of an exemplary infant safety device comprising a mattress or pad generally 24 comprising a first embodiment in accordance with the subject invention for apparatus and methodology for the prevention of infant asphyxiation during bed rest such as in a crib.

With reference to both FIGS. 2 and 3, a support pad generally 26 has an upper support surface 28 on which an infant 18 may be supported. The support pad is comprised of air permeable material 30 which resides beneath support surface 28 for the creation by such material of a breathing space below infant 18 received on upper support surface 28.

Forced air circulation means generally 32 functions for circulating oxygenated (i.e., fresh) air through the breathing space beneath the infant 18 so that carbon dioxide exhaled by an infant received on surface 28 is flushed from such breathing space. Such function prevents asphyxiation of the infant due to carbon dioxide poisoning. As illustrated throughout FIGS. 2 and 3 by numerous air flow lines, such as lines 34, air from forced air circulation means 32 is sent throughout (i.e., in both vertical and horizontal directions through) the breathing space formed by support pad 26. Not only is fresh or oxygenated air brought into the breathing space by such arrangement, but equally important, any carbon dioxide exhaled by infant 18 and any other potentially harmful gases are flushed or purged from the breathing space.

Figure 4:
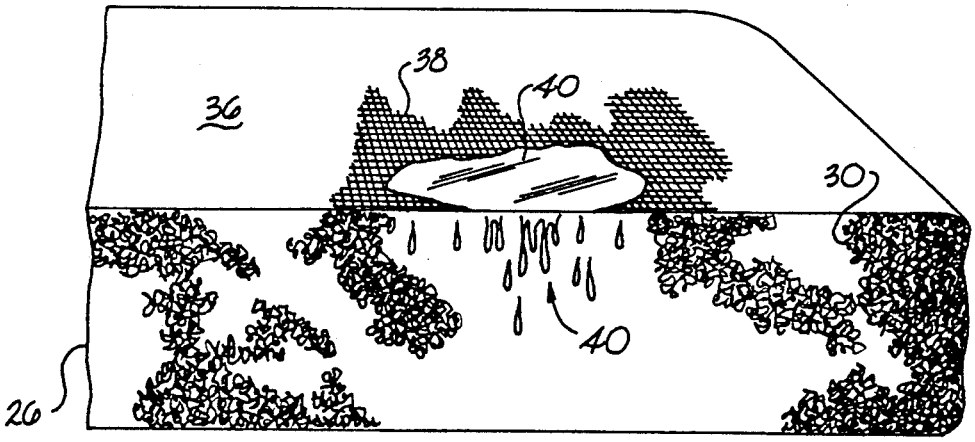
FIG. 4 is an enlarged side cross-sectional view of a portion of the embodiment of present FIG. 3.

FIG. 4 illustrates an enlarged cross-sectional view of present support pad 26 in accordance with a first embodiment of the subject invention comprised of air permeable material 30, and further alternately including in accordance with the subject invention fabric cover means 36. As shown in FIGS. 2 through 4, such fabric cover means are preferably fitted relatively tightly at least about the upper support surface 28. Furthermore, such fabric cover means when used are comprised of preferably air permeable material, which stills permits carbon dioxide to be flushed from a breathing space and oxygenated air to be circulated therethrough, as represented by present FIGS. 2 and 3.

Fabric cover means further preferably includes a relatively open weave washable fabric covering 38, as shown in FIG. 4. Not only is such an arrangement effective for the passage of gases as discussed above, but regurgitated fluids generally 40, such as milk, juice, or sugar water, may be drained through fabric 38 and away from an infant's face.

Still further, FIGS. 2 through 4 illustrate that fabric cover means 36 may be fitted about the upper support surface 28 and surfaces adjacent thereto such as sides 42 and 44. In such instances, the fabric covering 36 preferably includes at least one tube opening 46 formed therein, for purposes as discussed hereinafter.

Forced air circulation means generally 32 preferably comprises an air tube 48 (see FIGS. 2 and 3) at least partially embedded in support pad 26, and an air pump generally 50 operatively interconnected with air tube 48 and operating for forcing oxygenated air into such air tube. Preferably, such operation is continuous and at a relatively constant predetermined air flow rate. An air flow rate of generally less than about 1 cubic foot per minute is preferred in many instances so that the circulation of air will not have any undesired cooling effect against the skin of infant 18. Of course, in some embodiments, use of relatively higher air flow rates (such as above 1 cubic foot per minute) may be practiced intentionally for creating a corresponding cooling effect. Other methods of obtaining a cooling effect (or a desired heating effect) may be practiced in accordance with the subject invention, as discussed in greater detail below.

The air pump means comprising a combination of air pump 50 and air tube 48 draws fresh oxygenated air preferably from around the crib surroundings, although specific air sources (such as with an oxygen tank or the like) could be utilized in some embodiments of the subject invention. From whatever source, the oxygenated air (either pure oxygen, oxygen enriched air, or available fresh air with nominal oxygen levels) is pumped into the breathing space formed by pad 26 so as to expel any carbon dioxide from such breathing space and present fresh oxygenated air to the infant instead of accumulated exhaled carbon dioxide even whenever the infant is received face down onto the mattress upper support surface 28 as represented in present FIGS. 2 and 3.

Tubing 48 preferably may comprise flexible plastic tubing. Different embodiments may be practiced, including the use of reinforced hoses, similar to those of a vacuum cleaner or the like, reinforced heavy cloth or fabric tubing, or sections of hardened plastic tubing with flexible interconnections.

While tubing 48 may have a terminus point 52 just inside pad 26 as represented in present FIGS. 2 and 3, the dotted line illustration of present FIG. 3 shows an additional length 54 of such tubing so as to position an end 56 thereof relatively adjacent to a portion of mattress 26 where the head or face 22 of an infant recumbent thereon is intended to be placed. The predetermined position of end 56 can be varied depending on the size of the pad and/or the size of the infant. For example, the distance between end 56 and opening 46 could be varied within a given range, such as from about 10 to about 30 inches.

With reference to FIG. 3, in such instances of an extended length 54, the present breathing space in accordance with the subject invention may be considered to be the area more closely associated with the region in and around such end 56 and the nose and mouth in the front area 58 of the infant's head 22. In such instances, the broader aspects of the subject invention would still be applicable in that such breathing space would be purged of carbon dioxide accumulations in accordance with the subject invention, and the infant would instead be presented with fresh or oxygenated air. An opposite end 60 of tube 48 preferably is directly interconnected with air pump 50 so that air input to such end 60 is forwarded in the direction of arrows 62 so at to be forcibly circulated in the above-referenced breathing space.

As noted, the predetermined location of end 56 may be varied in accordance with the subject invention so as to accomplish the purposes set forth above. Such position could also be adjustable, which would be a particularly useful feature over the infancy of a child 18 since the intended or likely head location of an infant might move as the infant grows. An infant may be only about 18 to 22 inches at birth, and then grow to 36 inches or more in only 2 years time.

As represented by present FIGS. 2 and 3, air pump 50 may be a relatively simple pump, such as electric powered, portable, and supported on a nearby table 64 or in some instances attached to or supported on crib 10. A pump similar to the air circulation pump in an aquarium set is one example of appropriate type. In general, preferred types of air pumps will avoid the direct involvement of a compressor or similar mechanism so that no contamination, such as compressor lubricant or oil, will reach the air to be circulated.

Particularly as represented by present FIG. 2, such pump 50 may draw fresh oxygenated air from about its surroundings through a suitable opening or air filter in area 66 thereof. On the other hand, in some embodiments of the subject invention, a further tube 68 (FIG. 3) may be used for providing a specific source of oxygen or oxygenated air to air pump 50. As shown in FIG. 3, exemplary means 70 connected to tube 68 may comprise oxygen regulation means for controlling the amount of oxygen (i.e., nominal, enriched, or pure) supplied to air pump 50 and circulated. Alternatively, such means may be considered to represent air temperature regulation means or conditioning means 70 which may be further provided for desirably or selectively heating or cooling the supply of air 68 to air pump 50. In such fashion, an infant 18 may be effectively warmed even without use of an exterior blanket 72 or alternatively cooled, all from the air circulated thereto through tube 48. In other words, nominal temperature (and/or specific oxygen content) of the air circulated through the breathing space in accordance with the subject invention may be regulated or controlled in a desired fashion. A space heater, electric or otherwise, or a small air conditioner or fan unit or other cooling means may be practiced, the details of which are well known to those of ordinary skill in the art and form no particular features of the subject invention, wherefore further discussion thereof is omitted.

As represented in FIGS. 2 through 4, support pad 26 preferably comprises a generally rectangular crib mattress comprised of air permeable material 30. One preferred embodiment of such permeable material comprises reticulated foam. The manufacture of such foam is well known to those of ordinary skill in the art, and can make use of either chemical or thermal manufacturing techniques so as to create foam which is resilient similar to nonreticulated foam but which is rendered relatively air (and liquid) permeable. In other words, major interconnecting walls between foam cells are eliminated by the reticulation process so that a relatively open network of pores or openings remains, which is readily permeable by gases and liquids. With such an embodiment, the reticulated foam could also be rendered washable so as to remove or wash therefrom undesired fluids such as 40 (see FIG. 4) after a period of usage.

As further understood by those of ordinary skill in the art from the disclosure herewith, such generally rectangular mattress defines a breathing space of predetermined volume beneath the upper surface thereof, which volume in some instances may simply be the volume resulting from the combined length, width, and thickness (or depth) characteristics of the mattress. In the case of a conventional crib mattress, length of approximately 51 inches, width of approximately 28 inches, and thickness of approximately 6 or 6½ inches is common place. In preferred infant safety device embodiments of the subject invention comprising a full mattress substitute for a conventional crib mattress, the length of the mattress has a range preferably generally of about 45 to 55 inches, a width generally in a range of from about 25 to about 35 inches, and a thickness generally in a range of from about 4 to about 8 inches. Some present embodiments may comprise a relatively reduced size pad to be received onto another support element such as a main mattress. One such present pad embodiment may be about 30 inches in length, 20 inches in width, and 0.75 inches in thickness, though other pad dimensions may be practiced. For example, pad length may have a range of about 25 to about 35 inches, pad width a range of about 15 to about 25 inches, and pad thickness a range of about 0.5 to about 2 inches.

Figure 5:
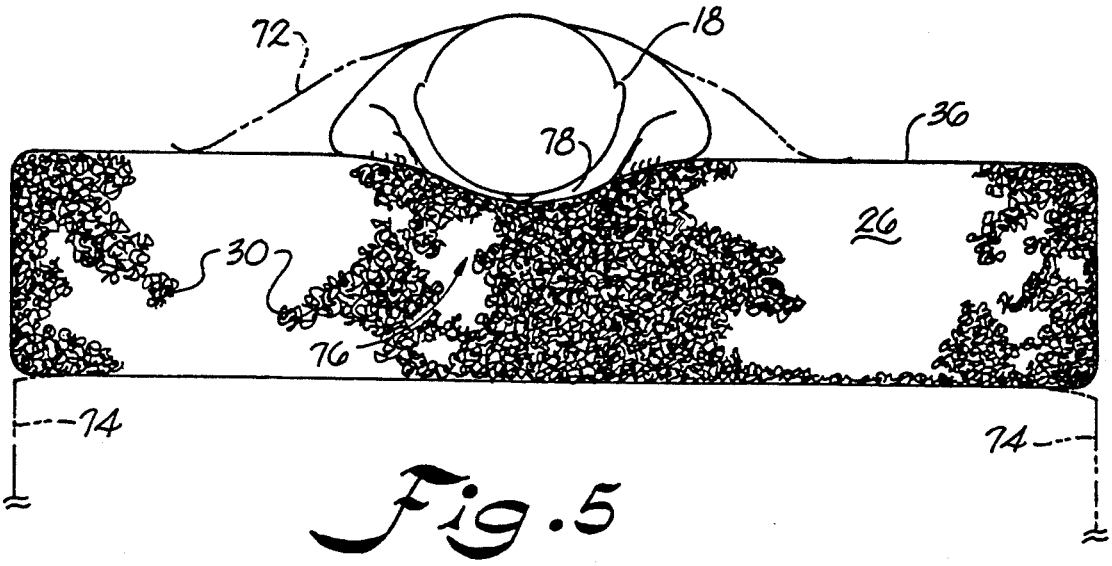
FIG. 5 is a further enlarged cross-sectional view of the embodiment of present FIG. 3, taken along the sectional line 5—5 indicated therein.
Figure 6:
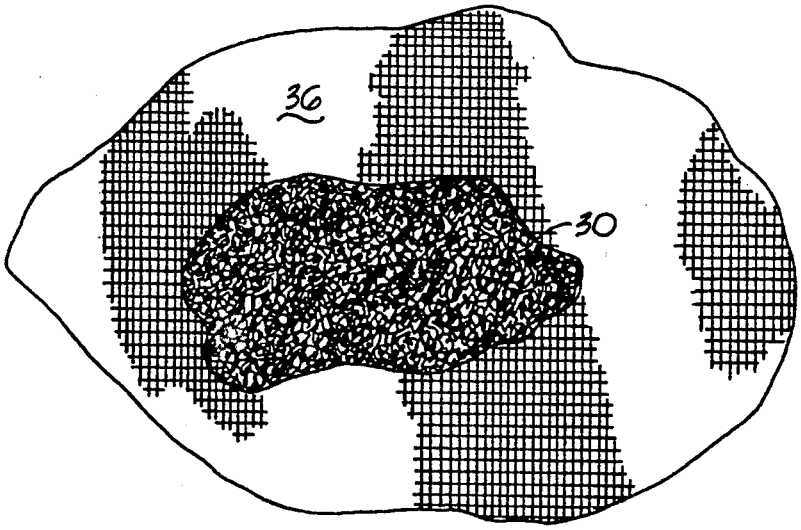
FIG. 6 is an enlarged partial sectional view of the region marked by section line 6—6 of present FIG. 2.

As represented in the cross-sectional view of present FIG. 5 (taken along the sectional line 5—5 of present FIG. 3), a support pad 26 in accordance with the subject invention may be used in combination with a further resilient or nonresilient support pad or other support element 74 therebeneath (represented in dotted line). Such representation is not necessarily intended as being drawn to scale since pads in accordance with the invention could appear much smaller (or even larger) relative to infant 18 and support 74. As shown in such figure, a breathing space generally 76 is formed in accordance with the subject invention in and about the face 78 of an infant 18 because of the reticulated foam or air permeable material 30 utilized throughout the construction of pad 26. FIG. 6 also represents a top view of such air permeable material 30 shown in partial cutaway in combination with fabric covering 36, which is also of air permeable material, as discussed above. Therefore, even whenever an infant is completely face down (a relatively worst case scenario), the present invention provides a support pad which creates a breathing space of air permeable material beneath the infant and circulates oxygenated air through such breathing space so as to dispel and flush out any exhaled carbon dioxide to prevent asphyxiation of the infant, and instead to provide fresh or oxygenated air to the infant for the prevention of SIDS from asphyxiation.

As will be appreciated by those of ordinary skill in the art, variations and modifications to the subject invention may be practiced. For example, support pads of different sizes may be practiced, even beyond those discussed above. In general, the size of the air tubing should be less than the thickness of the pad, but the pad thickness could otherwise be reduced in some embodiments as discussed above.

Similarly, while the subject invention is advantageously usable with infants not previously identified as being at risk, the invention is equally applicable to children and others older than infants who have been identified for at risk conditions. For example, some children may have been diagnosed with specific instances of breathing stoppage, or may possess other specific breathing disorders such as asthma or other conditions which would expand the risk sphere described above with respect to suspected SIDS causes from carbon dioxide poisoning. At the same time, practice of the subject invention advantageously permits total freedom of movement for the user infant or child since the entire arrangement is virtually transparent to the user, at least in that it does not involve use of an anesthesia mask or air tube to the nostrils of the user, or an overhead oxygen tent.

Figure 7:
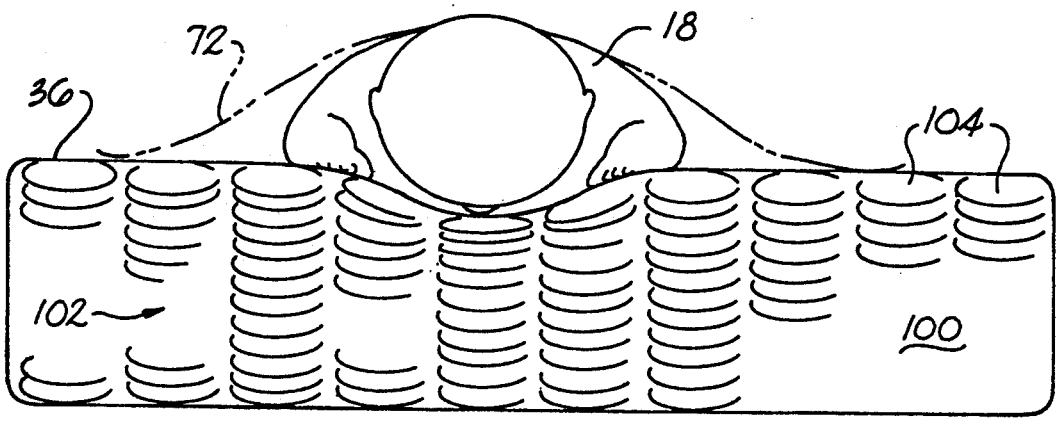
FIG. 7 is an enlarged cross-sectional view similar to the view of present FIG. 5, representing a second embodiment in accordance with the subject invention.

Still further, it will be understood by those of ordinary skill in the art that different air permeable materials may be practiced so as to provide a resilient mass of relatively open weave matter, such as represented by present FIG. 7. FIG. 7 illustrates a second exemplary embodiment of the subject invention having a pad 100 comprising an example of such relatively open weave matter 102. More specifically, the exemplary material 102 of present FIG. 7 may comprise resilient coils 104 formed such as from metal or plastic materials, and defining open air permeable passages in and around the coils thereof. The wire fabric of ventilated cushions for automobiles is one example of suitable material.

FIG. 7 illustrates a cross-sectional view of pad 100 similar to that illustrated in present FIG. 5, and again representing the optional included use of a fabric covering 36 and a blanket or covering 72 for infant 18. Use of variably or fixed embedded tubing such as tube extension 54 of present FIG. 3 may likewise be practiced, and other advantageous features of the prior embodiment (such as the liquid drainage represented in present FIG. 4) may also be obtained through practice of the FIG. 7 embodiment. For example, tube end 56 may be positioned a predetermined distance in mattress 26 or mattress 100 from fabric covering tube opening 46 so that the air tube first end 56 is situated relatively adjacent an area of the pad or crib mattress 26 where the head 22 of an infant recumbent thereon is intended to be placed.

Similarly, other features described above may be practiced in combination with mattress pad 100, which in general may be substituted for the mattress pad embodiment 26 as shown and described above in detail.

It should be further understood by those of ordinary skill in the art that the foregoing presently preferred embodiments are exemplary only, and that the attendant description thereof is likewise by way of words of example rather than words of limitation, and their use does not preclude inclusion of such modifications, variations, and/or additions to the present invention as would be readily apparent to one of ordinary skill in the art, the scope of the present invention being set forth in the appended claims.

What is claimed is:

1. Sudden infant death syndrome prevention apparatus, comprising:

a generally rectangular crib mattress comprised of predetermined innately air permeable reticulated foam;

a fitted relatively open weave fabric covering received about and surrounding at least the top and sides of said crib mattress, and having at least one tube opening formed therein;

an air tube having opposing first and second ends, said tube residing at least partially in said crib mattress and passing through said fabric covering tube opening, so that a first end of said air tube is received at a predetermined location inside of said crib mattress and a second end of said air tube is situated outside of said crib mattress; and an air pump operatively interconnected with said air tube second end and continuously pumping fresh oxygenated air into said air tube such that the fresh oxygenated air emerges from said air tube first end and is forced in both vertical and horizontal directions throughout and from said air permeable reticulated foam crib mattress at a predetermined limited air flow rate generally less than about one cubic foot per minute, to flush out and prevent any accumulation of exhaled carbon dioxide from an infant received in a prone position on said crib mattress without causing a cooling effect on such infant, and while any regurgitated fluids from the infant are drained through the fabric covering.

2. Apparatus as in claim 1, wherein:

said crib mattress has a length generally in a range of from about 45 to about 55 inches, a width generally in a range of from about 25 to about 35 inches, and a thickness generally in a range of from about 2 to about 8 inches;

said fabric covering comprises washable material; and said air tube comprises flexible plastic material with said air tube first end received a distance in said crib mattress generally in a range of from about 10 to about 30 inches from said fabric covering tube opening so that said air tube first end is situated relatively adjacent an area of said crib mattress where the head of an infant recumbent thereon is intended to be placed.

3. Apparatus as in claim 2, wherein said air pump pumps air through said air tube at a relatively constant predetermined air flow rate, and wherein said apparatus further includes conditioning means associated with said air pump for selectively controlling the nominal temperature of fresh oxygenated air being pumped through said air tube so as to correspondingly have a selected respective heating or cooling effect on an infant recumbent on said crib mattress.

4. Apparatus as in claim 1, wherein said crib mattress comprises a crib pad adapted to be supported by another primary support such as a main mattress, and having a length generally in a range of from about 25 to about 35 inches, a width generally in a range of from about 15 to about 25 inches, and a thickness generally in a range of from about 0.5 to about 2 inches.

5. Apparatus as in claim 1, wherein said air pump pumps air without contaminating same, and wherein said apparatus further includes oxygen regulation means for controlling the amount of oxygen in the air pumped by said air pump.

6. A method of preventing infant asphyxiation during periods of infant bed rest, such as in a crib, said method comprising:

providing a support pad having an upper support surface and comprised of predetermined innately air permeable material therebeneath, which is air permeable in both vertical and horizontal directions, so that a breathing space of predetermined volume is created below an infant received on said upper support surface; and forcibly circulating oxygenated air in both vertical and horizontal directions throughout and from said breathing space at a predetermined limited air flow rate matched with said predetermined volume thereof, for flushing from said breathing space carbon dioxide exhaled by an infant received on said upper support surface, said predetermined limited air flow rate being selected so as to prevent asphyxiation of the infant due to carbon dioxide poisoning without causing a cooling effect on such infant;

wherein said circulating step includes inserting an air tube into a predetermined location inside said support pad, and operatively interconnecting an air pump with said air tube and operating such air pump for continuously forcing oxygenated air from around said air pump into said air tube; and further wherein said predetermined air flow rate is generally less than about one cubic foot per minute.

7. A method as in claim 6 further including removably fitting a relatively open weave washable fabric covering about at least said support pad upper support surface.

8. A method as in claim 24, wherein said providing step includes providing a support pad comprised of reticulated foam.

9. A method as in claim 6, wherein said providing step includes providing a support pad comprised of a resilient mass of relatively open weave matter.

10. A method as in claim 9, wherein said air permeable resilient mass comprises resilient coils formed of one of metal and plastic materials.

11. A method as in claim 6, further including the step of regulating the nominal temperature of oxygenated air circulated through said breathing space so as to have a desired cooling or heating effect on an infant recumbent on said support pad.

12. A method as in claim 6, wherein said pad has a thickness in a range of from about 0.5 to about 2 inches.

13. A method as in claim 6, wherein said pad comprises a mattress having a thickness in a range of from about 2 to about 8 inches.

14. A method as in claim 6, wherein said circulating step includes providing enhanced levels of oxygen in said oxygenated air.

15. A method as in claim 14, wherein said enhanced levels of oxygen comprises pure oxygen.

16. A method as in claim 6, wherein said circulating step includes circulating oxygenated air through said breathing space without contamination thereof.

17. Sudden infant death syndrome prevention apparatus, comprising:

a generally rectangular crib mattress comprised of air permeable reticulated foam;

a fitted relatively open weave fabric covering comprising washable material, received about said crib mattress, and having at least one tube opening formed therein;

an air tube comprised of flexible plastic material and having opposing first and second ends, said tube residing at least partially in said crib mattress and passing through said fabric covering tube opening, so that a first end of said air tube is received at a predetermined location inside of said crib mattress at a distance generally in a range of from about 10 to about 30 inches from said fabric covering tube opening so that said air tube first end is situated relatively adjacent an area of said crib mattress where the head of an infant recumbent thereon is intended to be placed, and said tube residing so that a second end of said air tube is situated outside of said crib mattress; and an air pump operatively interconnected with said air tube second end and continuously pumping fresh oxygenated air into said air tube such that the fresh oxygenated air emerges from said air tube first end and is forced throughout said air permeable reticulated foam crib mattress to flush out and prevent any accumulation of exhaled carbon dioxide from an infant received in a prone position on said crib mattress, while any regurgitated fluids from the infant are drained through the fabric covering;

wherein said air pump pumps air without contaminating same, and wherein said apparatus further includes oxygen regulation means for controlling the amount of oxygen in the air pumped by said air pump.

18. Apparatus as in claim 17, wherein said crib mattress has a length generally in a range of from about 45 to about 55 inches, a width generally in a range of from about 25 to about 35 inches, and a thickness generally in a range of from about 2 to about 8 inches.

19. Apparatus as in claim 17, wherein said air pump pumps air through said air tube at a relatively constant predetermined air flow rate generally less than about 1 cubic foot per minute.

20. Apparatus as in claim 19, wherein said apparatus further includes conditioning means associated with said air pump for selectively controlling the nominal temperature of fresh oxygenated air being pumped through said air tube so as to correspondingly have a selected respective heating or cooling effect on an infant recumbent on said crib mattress.

21. Apparatus as in claim 17, wherein said crib mattress comprises a crib pad adapted to be supported by another primary support such as a main mattress, and having a length generally in a range of from about 25 to about 35 inches, a width generally in a range of from about 15 to about 25 inches, and a thickness generally in a range of from about 0.5 to about 2 inches.

22. Sudden infant death syndrome prevention apparatus, comprising:

generally rectangular crib mattress comprised of a predetermined innately air permeable resilient mass of relatively open weave matter;

a fitted relatively open weave fabric covering received about and surrounding at least the top and sides of said crib mattress, and having at least one tube opening formed therein;

an air tube having opposing first and second ends, said tube residing at least partially in said crib mattress and passing through said fabric covering tube opening, so that a first end of said air tube is received at a predetermined location inside of said crib mattress and a second end of said air tube is situated outside of said crib mattress; and an air pump operatively interconnected with said air tube second end and continuously pumping fresh oxygenated air into said air tube such that the fresh oxygenated air emerges from said air tube first end and is forced in both vertical and horizontal directions throughout and from said air permeable resilient mass crib mattress at a predetermined limited air flow rate generally less than about one cubic foot per minute, to flush out and prevent any accumulation of exhaled carbon dioxide from an infant received in a prone position on said crib mattress without causing a cooling effect on such infant, and while any regurgitated fluids from the infant are drained through the fabric covering.

23. Apparatus as in claim 22, wherein said air permeable resilient mass comprises resilient coils formed of one of metal and plastic materials.

24. Apparatus as in claim 22, wherein:

said crib mattress has a length generally in a range of from about 45 to about 55 inches, a width generally in a range of from about 25 to about 35 inches, and a thickness generally in a range of from about 2 to about 8 inches;

said fabric covering comprises washable material; and said air tube comprises flexible plastic material with said air tube first end received a distance in said crib mattress generally in a range of from about 10 to about 30 inches from said fabric covering tube opening so that said air tube first end is situated relatively adjacent an area of said crib mattress where the head of an infant recumbent thereon is intended to be placed.

25. Apparatus as in claim 22, wherein said air pump pumps air through said air tube at a relatively constant predetermined air flow rate, and wherein said apparatus further includes conditioning means associated with said air pump for selectively controlling the nominal temperature of fresh oxygenated air being pumped through said air tube so as to correspondingly have a selected respective heating or cooling effect on an infant recumbent on said crib mattress.

26. Apparatus as in claim 22, wherein said crib mattress comprises a crib pad adapted to be supported by another primary support such as a main mattress, and having a length generally in a range of from about 25 to about 35 inches, a width generally in a range of from about 15 to about 25 inches, and a thickness generally in a range of from about 0.5 to about 2 inches.

27. Apparatus as in claim 22, wherein said air pump pumps air without contaminating same, and wherein said apparatus further includes oxygen regulation means for controlling the amount of oxygen in the air pumped by said air pump.

* * * * *

UNITED STATES PATENT AND TRADEMARK OFFICE

CERTIFICATE OF CORRECTION

PATENT NO. : 5,317,767

DATED : June 7, 1994

INVENTOR(S) : Hargest, et al.

It is certified that error appears in the above-identified patent and that said Letters Patent is hereby corrected as shown below:

Col. 13, Claim 8, line 1, change "24" to --6-- .

Signed and Sealed this

Sixteenth Day of May, 1995

*Attest:*

Bruce Lehman

BRUCE LEHMAN

*Attesting Officer*

*Commissioner of Patents and Trademarks*